US005678371A

United States Patent [19]

Wills

[11] Patent Number: 5,678,371

[45] Date of Patent: Oct. 21, 1997

[54] VAPOR BARRIER PANEL FOR USE IN A BUILDING STRUCTURE

[76] Inventor: Mark E. Wills, 83 Eastcote Drive, Winnipeg, Manitoba, Canada, R2N 2Y7

[21] Appl. No.: 590,506

[22] Filed: Jan. 24, 1996

[51] Int. Cl.[6] ..... E04B 1/62

[52] U.S. Cl. ..... 52/408; 52/94; 52/293.3; 52/407.3; 52/412; 52/404.1

[58] Field of Search ..... 52/408, 411, 412, 52/407.3, 407.4, 407.5, 404.5, 404.1, 302.6, 317, 366, 94, 61, 62, 236.7, 293.3

[56] References Cited

U.S. PATENT DOCUMENTS

| | | | |
|---|---|---|---|
| 332,491 | 12/1885 | Clay | 52/317 X |
| 1,317,471 | 9/1919 | Alsruhe | 52/293.1 |
| 1,566,447 | 12/1925 | Theriault | 52/404.1 X |
| 1,852,917 | 4/1932 | Burgett | 52/696 |
| 1,947,954 | 2/1934 | Piland | 52/317 |
| 2,964,807 | 12/1960 | Kennedy | 52/696 |
| 3,035,374 | 5/1962 | Allen | 52/289 |
| 4,125,982 | 11/1978 | Ward | 52/404.1 |
| 4,185,433 | 1/1980 | Cantrell | 52/94 |
| 4,804,094 | 2/1989 | Eittreim | 52/317 X |
| 4,972,635 | 11/1990 | Wageman | 52/94 |
| 5,007,216 | 4/1991 | Pearson | 52/94 |
| 5,412,920 | 5/1995 | Hess | 52/698 X |

FOREIGN PATENT DOCUMENTS

| | | | |
|---|---|---|---|
| 213039 | 3/1987 | European Pat. Off. | 52/407.3 |

*Primary Examiner*—Carl D. Friedman
*Assistant Examiner*—Laura A. Saladino
*Attorney, Agent, or Firm*—Adrian D. Battison; Murray E. Thrift

[57] ABSTRACT

A vapor barrier panel is designed specifically for application to the area between the floor joists and under the sub floor and in front of a concrete basement wall. The panel body includes a flat panel section with a flange at the top edge at right angles to the top edge and two flanges down each side. The panel body is thus applied so that the top flange engages against the underside of the sub floor and the side flanges engage against the sides and bottom respectively of the floor joists. The panel is semi rigid so they can be applied in place simply by sliding into position and abutting against a bead of sealant applied to the floor and floor joists or pre-applied to and carried on the outside surface of each flange.

9 Claims, 3 Drawing Sheets

VAPOR BARRIER PANEL FOR USE IN A BUILDING STRUCTURE

BACKGROUND OF THE INVENTION

This invention relates to a vapor barrier panel for use in a building structure designed specifically for application to the area between the floor joists and under the sub-floor in the building. The panel can be used at any floor of a wood construction building from the first floor, in which the panel is located in front of the basement wall, to the upper floor or floors.

Modern building constructions in colder climates require a vapor barrier to be applied on the inside surface of the wall studs so as to cover insulation between that inside surface and the outside surface of the wall. This vapor barrier layer is readily applied during construction simply by filling the spaces between the wall studs with insulation and then applying the vapor barrier over the insulation. The vapor barrier is simply a thin flexible plastics material which has little or no stiffness so that it can be draped into position and stapled in place.

It is important to provide vapor barrier protection to insulation installed between the ends of floor joists. It is usually very difficult to achieve an effective air barrier at this location because the materials must be cut and fitted between the joists. Extra care is therefore required especially at the higher floors where air exfiltration is more likely to occur.

At the present time this process is carried out using the flexible polyethylene material which is draped into place and stapled onto floor joists and floor using in some cases a sealant. This is a time consuming and difficult task since the flexible material must be folded and bent into shape while at the same time holding it in position and then attaching it in position.

SUMMARY OF THE INVENTION

It is one object of the present invention, therefore, to provide an improved vapor barrier panel which can be used in the area of the floor joists.

According to one aspect of the invention there is provided a vapor barrier panel for use in a building structure comprising; a molded integral body defining a main flat panel having a bottom edge, a top edge and two side edges; a first flange attached to the panel at the top edge and extending at right angles thereto along a full length thereof; each side edge having a first portion at right angles to the top edge and extending therefrom, a second portion at right angles to the first portion and parallel to the top edge, the second portions being directed in opposed directions so as to extend apart, and a third portion connected to an outer edge of the second portion and extending therefrom at right angles so as to be spaced outwardly of the first portion and parallel thereto; two second flanges each attached to the panel at the first portion of a respective one of the side edges and extending at right angles to the panel; two third flanges each attached to the panel at the second portion of a respective one of the side edges and extending at right angles to the panel; all of the first, second and third flanges extending to the same side of the panel; the third portions and the bottom edge being free from flanges such that a bottom portion of the panel between the third portions forms a flat flap portion depending below the third flanges; the body being integrally molded from a thin material which material has sufficient strength that the flanges are self supporting at said right angles to the panel and which material is impermeable to moisture vapor.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 3:
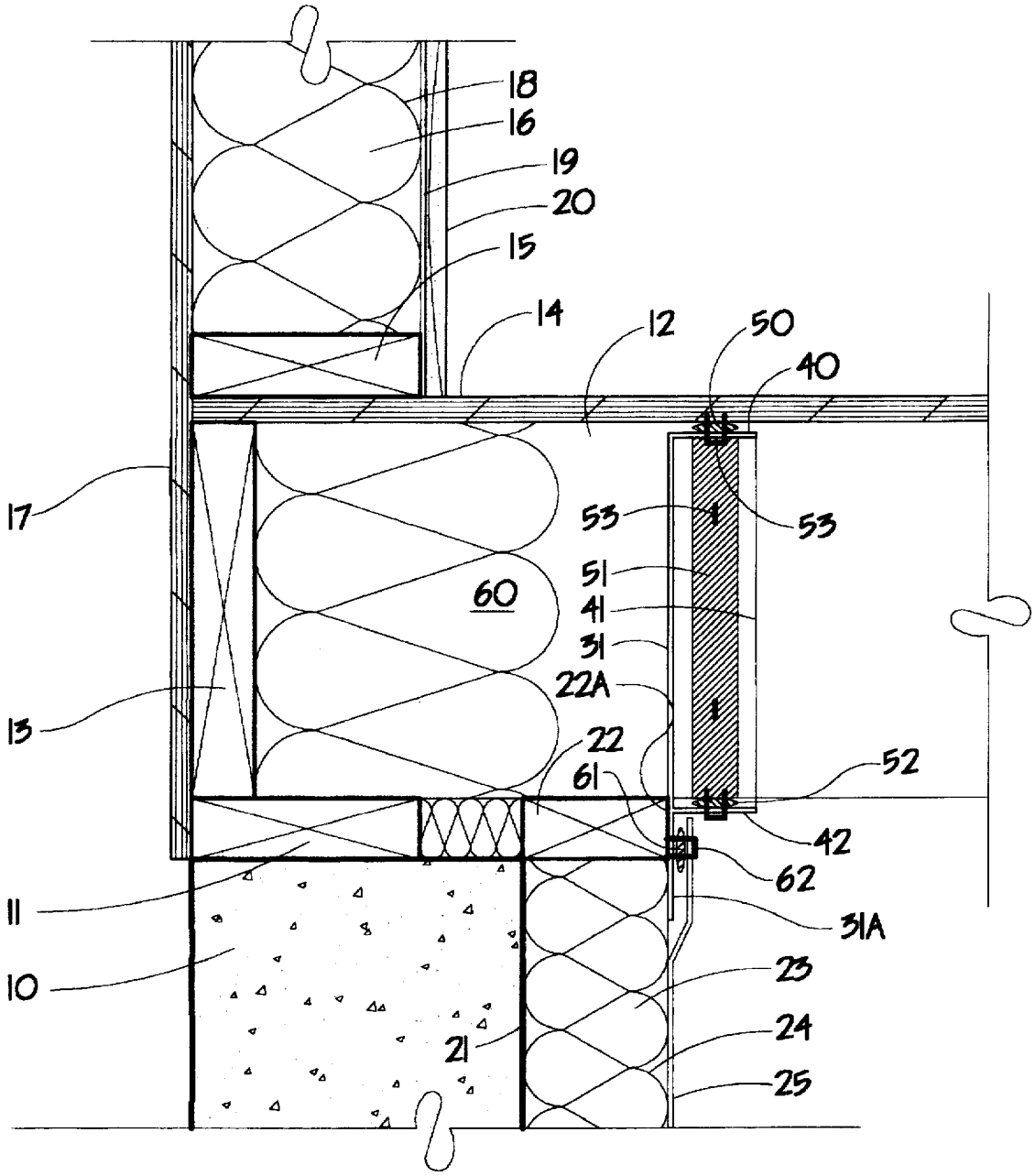
FIG. 3 is a vertical cross section through a building structure showing the location of the panel of FIGS. 1 and 2.

Turning firstly to FIG. 3, a conventional building structure is shown including a concrete basement wall 10 on top of which is mounted a wooden sill plate 11. On top of the sill plate is mounted a series of parallel floor joists 12 which are connected together at their ends by a header 13. The header 13 and the floor joist 12 are carried on top of the sill plate 11 and are supported thereby. On top of the floor joists is applied a sub floor layer, generally of plywood, which is indicated at 14. On top of the sub floor 14 is mounted the wall construction including a sill plate 15 and a plurality of wall studs 16. The outside of the wall including the header 13 is clad by an exterior sheathing layer 17 such as plywood. Between the wall studs is applied a layer 18 of insulation which is then covered by a vapor barrier layer 19 and a layer of drywall 20.

On the inside surface 21 of the concrete basement wall is applied a layer of strapping including a horizontal top rail 22 and a plurality of vertical studs 23. Between the studs is applied a layer of insulation 24 and a vapor barrier 25 is applied over the insulation.

The present invention is concerned with the area between the floor joists 12, underneath the sub floor 14 and on top of the sill plate 11 and the top rail 22. It is of course necessary to insulate this area and to apply a vapor barrier over the insulation. The vapor barrier panel as shown in FIGS. 1 and 2 is designed specifically for attachment in this area.

Figure 1:
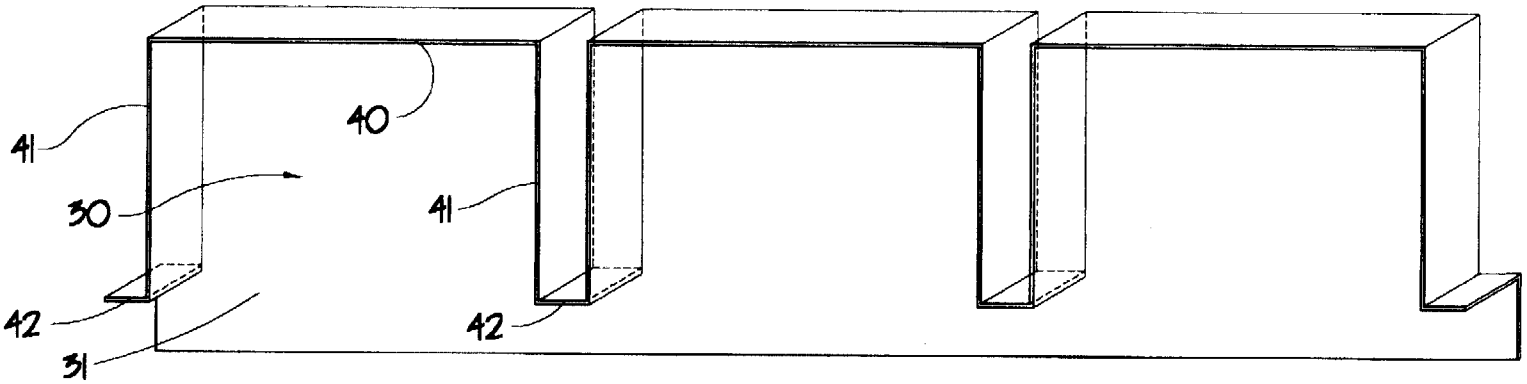
FIG. 1 is an isometric view of a vapor barrier panel according to the invention.
Figure 2:
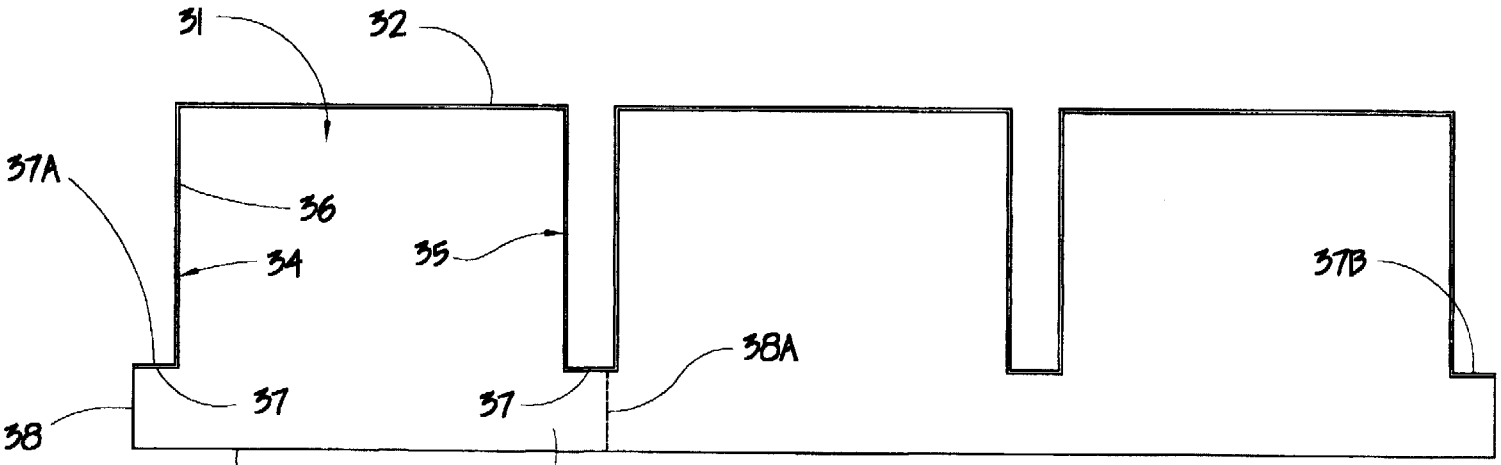
FIG. 2 is a front elevational view of the panel of FIG. 1.

The panel as shown in FIGS. 1 and 2 comprises a panel body generally indicated at 30 including a main flat panel 31.

Figure 4:
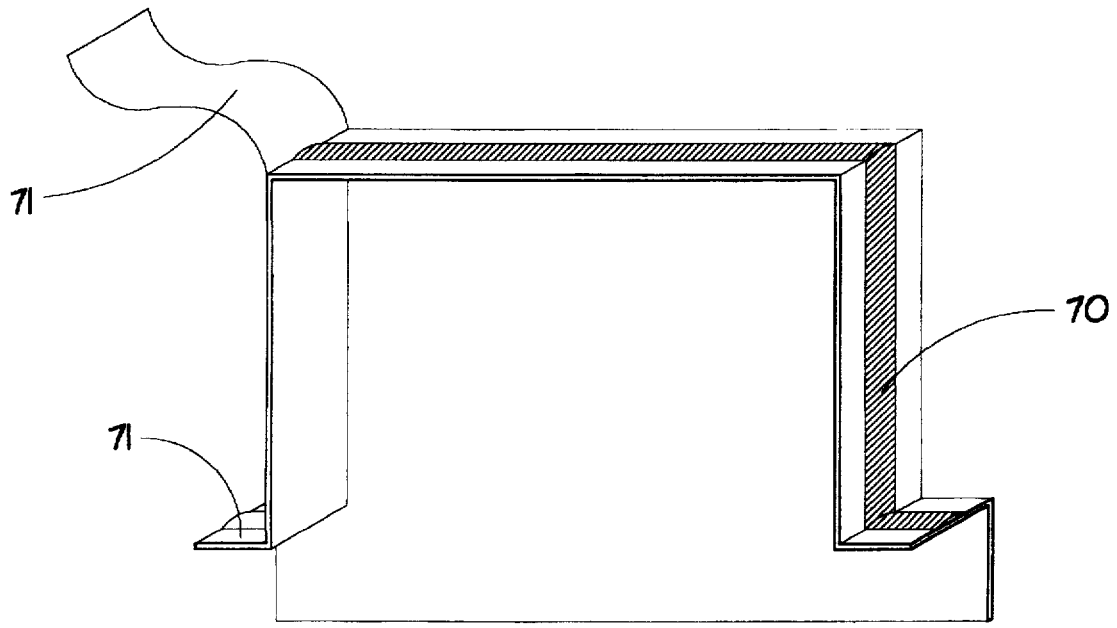
FIG. 4 is an isometric view similar to that of FIG. 1 showing a modified panel including only a single panel portion and including a preapplied bead of sealant.

As shown in FIGS. 1 and 2, the panel 30 includes three portions which are integrally formed or interconnected together. It will be appreciated that in this arrangement such a panel may be formed from a single such portion as shown in FIG. 4, from two such portions, from three such portions as shown or from a greater number of portions as desired.

The following description therefore will relate to one of the three portions of FIGS. 1 and 2 such portion and it will be appreciated that each of the other portions is identical. The main flap panel 31 therefore includes a top edge 32 and a bottom edge 33. The flap panel also includes a first side edge 34 and a second side edge 35. Each of the side edges includes a first portion 36 which is at right angles to the top edge 32 and intersects therewith. The side edge further includes a second portion 37 which lies at right angles to the first portion 34 and extends outwardly therefrom so that it is parallel to the top edge 32 and the bottom edge 33. Each side edge further includes a third portion 38 which is at right angles to the portions 37 and thus interconnects the .second portion 37 with the bottom edge 33. The third portion of the second side edge 35 is indicated at 38A. In the embodiment shown where there are three such portions interconnected together, the line 38A is imaginary. In a single portion, the portion would be separated at the line 38A and distinct from other such portions.

The top edge includes a first flange 40 which lies at right angles to the main panel 31 and extends outwardly therefrom. Each of the first portions 36 includes a second flange 41 which again is at right angles to the panel 30. Each of the third portions 37 has a third flange 42 which again is at right angles to the panel 31. Each of the flanges 40, 41 and 42 extends along the full length of the respective edge. Each of the flanges 40, 41 and 42 projects out to the same side of the panel. Each of the flanges 40, 41 and 42 is interconnected to the next adjacent flange so that the flanges 40, 41 and 42 form a continuous strip from the outermost end of one of the third flanges 42 through each of the flanges 40 and 41 to the outermost end of the other of the third flanges 42.

The bottom edge and the third portions of the side edges are all free from such flanges so that the bottom edge forms a flap defined simply by the flat sheet of the panel itself.

The structure is molded integrally from a suitable air and vapor impermeable layer, such as a thin plastics material for example polyethylene, which has sufficient thickness and stiffness so that the flanges are in effect self supporting and remain in position substantially at right angles to the panel while the structure is separate from the building structure and is stored, packaged or applied. Other materials such as foil covered cardboard or coated kraft paper can also be used.

As the panel structure is intended to be applied in the area of the floor joists so that each floor joist sits against the first side portion with its bottom edge against the second side portion, the length of the first side portion is necessarily greater than that of the second side portion to accommodate the dimensions of the joist.

Also in most constructions, the spacing between the joists is greater than the height of the joists themselves so that the top edge has a length which is greater than that of the first side portion of the side edge.

The panel body is applied as shown in FIG. 3. Thus a layer of sealant 50 is applied across the underside of the floor 14 at a position immediately in front of the front surface 22A of the strapping 22. Similarly a bead of sealant is applied as indicated at 51 along each side of each of the floor joists. A third bead 52 of sealant is applied on the bottom surface of each of the floor joists or on the flanges of the panel. The sealant beads are aligned.

With the sealant beads in place, the panel body is moved into position so that the top flange 40 engages against the bead 50. The second flanges 41 engage against the beads 51 and the third flange 42 engages against the bead 52. With the panel body in place, staples 53 are applied through the flanges to attach the flanges to the respective surfaces with the staples being applied through the beads to maintain air and vapor impermeability.

The flap portion 31A underneath the flanges 42 extends downwardly across the front face 22A of the upper rail 22 of the strapping and extends partly onto the struts 23 of the strapping. It will normally have a length of the order of 3 to 6 inches to provide sufficient overlap with the overlying vapor barrier sheet.

The panel 31 thus closes off from air/moisture penetration the area between the studs and underneath the floor so as to prevent penetration to the insulation 60 in that area.

Once the panel body is in place, a conventional sheet of vapor barrier material as indicated at 25 is applied on top of the flap 31A using a bead 61 of sealant and a staple 62.

The panel body of the present invention can therefore be applied very quickly since it is structurally substantially rigid and is moved into in place for securing by staples simply by pushing into place after the bead of sealant has been applied.

As shown in FIGS. 1 and 2, the end flanges indicated at 37A and 37B are arranged so that when a next adjacent panel body is applied these flanges overlap with sealant applied between them to maintain the integrity of the seal. The number of overlapping flanges 37A and 37B is increased if the size of the panels or the number of panels is reduced and therefore it is desirable to provide a panel body which has the maximum number of panel portions consistent with reasonable manufacturing abilities and reasonable handling or packaging. However in the ultimate situation, the panel bodies may be formed as single panel portions with an overlap at each joist.

In an alternative arrangement, not shown, the flap 31A can be increased in length so that it extends downwardly over the whole of the strapping of the basement wall.

While the above description relates only to the use in the basement area or crawl space, it will be appreciated that the panel can also be used in the area under the floor of the second and third floors in which case the flap 31A extends over the double top plate at the top of each wall.

In FIG. 4 is shown a modified arrangement in which the panel body includes only a single panel portion. In addition the panel is modified in that it carries a pre-applied layer or bead 70 of sealant on the outside surfaces of each of the flanges. As this bead is applied during the manufacturing stage and is carried to the installation site on the panel body it is protected during transportation and storage by a covering layer 71 which is applied over the bead and can readily be pealed away as shown in FIG. 4. The thickness and width of the bead is sufficient to allow formation of a vapor seal between the outside surface of each flange and its adjacent contact surface when installed.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A vapor barrier panel in a building structure, the building structure comprising:

a substantially vertical building wall;

a plurality of spaced, parallel, horizontal floor joists arranged at the wall and extending outwardly therefrom generally at right angles thereto, the floor joists each including two vertical side surfaces, a horizontal top surface and a horizontal bottom surface;

and a floor having a bottom surface lying over the top surfaces of the floor joists;

the vapor barrier panel comprising;

a molded integral body defining a main flat panel having a bottom edge, a top edge and two side edges, the main panel being vertical and arranged to bridge an area underneath the floor and in between two of the floor joists;

a horizontal first flange attached to the main panel at the top edge and extending at right angles thereto along a full length thereof, the first flange being attached to the bottom surface of the floor;

each side edge having a first portion generally at right angles to the top edge and extending therefrom, a length of the first portion being equal to a height of an adjacent one of the floor joists and the first portion being shaped such that the first portion lies along a side surface of the adjacent one of the floor joists from the top surface to the bottom surface thereof; and a second portion at right angles to the first portion and parallel to the top edge, the second portions being directed in opposed directions so as to extend apart and the second portions each lying along the bottom surface of the adjacent one of the floor joists;

two vertical second flanges each attached to the main panel at the first portion of a respective one of the side edges and extending at right angles to the main panel, each of the second flanges being shaped so as to lie along and being attached to the side surface of the adjacent one of the floor joists;

and two third flanges each attached to the main panel at the second portion of a respective one of the side edges and extending at right angles to the main panel, each of the third flanges lying along and being attached to the bottom surface of the adjacent one of the floor joists;

all of the first, second and third flanges extending in the same direction from the main panel;

the main flat panel including a flat flap portion depending below the third flanges to the bottom edge which is located at a position below an imaginary horizontal line joining the third flanges;

the body being integrally molded from a thin material which material has sufficient strength that the flanges are self supporting at said right angles to the main panel and which material is impermeable to moisture vapor.

2. The vapor barrier panel in a building structure according to claim 1 wherein the first, second and third flanges are connected to form an integral strip at said right angles to the main flat panel.

3. The vapor barrier panel in a building structure according to claim 1 wherein the flap portion has a depth of the order of 3 to 6 inches.

4. The vapor barrier panel in a building structure according to claim 1 wherein the second portions of the side edges have a length less than that of the first portions of the side edges.

5. The vapor barrier panel in a building structure according to claim 1 wherein the top edge has a length greater than that of the first portion of the side edge.

6. The vapor barrier panel in a building structure according to claim 1 wherein the first, second and third flanges each carry on an outside surface thereof a bead of sealant.

7. A vapor barrier panel in a building structure, the building structure comprising:

a substantially vertical building wall;

a plurality of spaced, parallel, horizontal floor joists arranged at the wall and extending outwardly therefrom generally at right angles thereto, the floor joists each including two vertical side surfaces, a horizontal top surface and a horizontal bottom surface;

and a floor having a bottom surface lying over the top surfaces of the floor joists;

the vapor barrier panel comprising;

a molded integral body defining at least two main flat panel portions each having a bottom edge, a top edge and two side edges, the main panel portions being vertical and each arranged to bridge an area underneath the floor and in between two of the floor joists, the main panel portions being arranged side by side so as to bridge the areas between adjacent floor joists;

each main panel portion including a horizontal first flange attached to the main panel portion at the top edge and extending at right angles thereto along a full length thereof, the first flange being attached to the bottom surface of the floor;

each side edge of each main panel portion having a first portion generally at right angles to the top edge and extending therefrom, a length of the first portion being equal to a height of an adjacent one of the floor joists and the first portion being shaped such that the first portion lies along a side surface of the adjacent one of the floor joists from the top surface to the bottom surface thereof; and a second portion at right angles to the first portion and parallel to the top edge, the second portions being directed in opposed directions so as to extend apart and the second portions each lying along the bottom surface of the adjacent one of the floor joists;

each main panel portion including two vertical second flanges each attached to the main panel portion at the first portion of a respective one of the side edges and extending at right angles to the main panel portion, each of the second flanges being shaped so as to lie along and being attached to the side surface of the adjacent one of the floor joists;

and each main panel portion including two third flanges each attached to the main panel portion at the second portion of a respective one of the side edges and extending at right angles to the main panel portion, each of the third flanges lying along and being attached to the bottom surface of the adjacent one of the floor joists;

all of the first, second and third flanges extending in the same direction from the main panel portions;

the main panel portions each including a flat flap portion depending below the third flanges to the bottom edge which is located at a position below an imaginary horizontal line joining the third flanges;

each of the main panel portions being connected to the next adjacent main panel portions at adjacent ones of the third flanges and at the flap portions such that the third flanges underlying and attached to the bottom surface of one of the floor joists between two of the adjacent areas are integral and the flap portions depending downwardly from the two of the adjacent areas are integral;

the body being integrally molded from a thin material which material has sufficient strength that the flanges are self supporting at said right angles to the main panel portion and which material is impermeable to moisture vapor.

8. The vapor barrier panel in a building structure according to claim 7 wherein the first, second and third flanges of each of the main panel portions are connected to form an integral strip at said right angles to the main panel portions.

9. The vapor barrier panel in a building structure according to claim 7 wherein the first, second and third flanges each carry on an outside surface thereof a bead of sealant.

* * * * *